US006779694B2

(12) United States Patent
Young

(10) Patent No.: US 6,779,694 B2
(45) Date of Patent: Aug. 24, 2004

(54) VENTED FLUID CLOSURE AND CONTAINER

(76) Inventor: John L. Young, 12425 Honolulu Ter., Whittier, CA (US) 90601-2328

( * ) Notice: Subject to any disclaimer, the term of this patent is extended or adjusted under 35 U.S.C. 154(b) by 0 days.

(21) Appl. No.: 10/267,306

(22) Filed: Oct. 9, 2002

(65) Prior Publication Data

US 2003/0066850 A1 Apr. 10, 2003

Related U.S. Application Data

(63) Continuation-in-part of application No. 09/994,303, filed on Nov. 26, 2001, now abandoned, which is a continuation-in-part of application No. 09/736,350, filed on Dec. 14, 2000, now abandoned.

(51) Int. Cl.[7] ..... B67D 3/00

(52) U.S. Cl. ..... 222/525; 222/481.5; 222/484; 222/562; 222/558; 215/307; 220/367.1; 220/373

(58) Field of Search ..... 222/521–525, 222/481.5, 484, 479, 482, 553, 556, 562, 564, 558, 442; 215/229, 309, 307; 220/367.1, 373

(56) References Cited

U.S. PATENT DOCUMENTS

| | | | | |
|---|---|---|---|---|
| 354,106 A | | 12/1886 | Dorwart | |
| 602,338 A | | 4/1898 | Larrison | |
| 988,804 A | | 4/1911 | Moore | |
| 1,648,029 A | | 11/1927 | Rhodes | |
| 1,654,507 A | | 12/1927 | Boe | |
| 1,770,464 A | | 7/1930 | Donnelly et al. | |
| 1,861,483 A | | 6/1932 | Simpson | |
| 1,891,280 A | | 12/1932 | Hazlett et al. | |
| 1,977,302 A | * | 10/1934 | Brill | 220/833 |
| 2,123,694 A | | 7/1938 | Denbow et al. | |
| 2,330,939 A | | 10/1943 | Wilson | |
| 2,345,737 A | | 4/1944 | Fabrice | |
| 2,431,192 A | * | 11/1947 | Munson | 222/209 |
| 2,435,033 A | | 1/1948 | Campbell | |
| 2,500,199 A | * | 3/1950 | Nesset | 604/407 |

(List continued on next page.)

FOREIGN PATENT DOCUMENTS

| | | |
|---|---|---|
| EP | 0 621 200 A1 | 10/1994 |
| FR | 2657846 | 8/1991 |

OTHER PUBLICATIONS

Playtex QuickStraw leak–proof bottle with child–proof straw product packaging, copyright 1996, 1997, 2000 (front, back, bottom).

Playtex Quick–Straw straw bottle product packaging, copyright 2001 (front, back, bottom).

*Primary Examiner*—Frederick C. Nicholas
(74) *Attorney, Agent, or Firm*—Ronald L. Wanke; Jenner & Block LLP

(57) ABSTRACT

A vented closure for a fluid container which will not freely pour includes a cap movable between open and closed positions relative to an annular base collar. The movable cap can be slidable to form a push-pull type closure, or can be rotatable to form a flip-type closure. In an open position, a primary liquid passageway extends through the closure to a dispensing opening. One or more air vents of small size are located in the base collar at positions spaced within a predetermined range of offsets from the dispensing opening. A divider is located to create a secondary liquid passageway to convey liquid directly into contact with the air vents which self-seal by surface tension of the liquid. The vent aperture can be protected by overlapping portions of the movable cap.

18 Claims, 6 Drawing Sheets

U.S. PATENT DOCUMENTS

| | | | | |
|---|---|---|---|---|
| 2,544,382 | A | | 3/1951 | Grunwald et al. |
| 2,812,122 | A | | 11/1957 | Magovern |
| 3,036,747 | A | | 5/1962 | Girard |
| 3,168,968 | A | | 2/1965 | Krakowsky |
| 3,198,393 | A | | 8/1965 | Kitterman |
| 3,225,971 | A | | 12/1965 | Curci |
| 3,253,726 | A | | 5/1966 | Meierhoefer |
| 3,369,720 | A | | 2/1968 | Libit et al. |
| 3,384,276 | A | | 5/1968 | Henningfield |
| 3,464,592 | A | | 9/1969 | Stroop |
| 3,655,102 | A | | 4/1972 | Moran |
| 3,750,915 | A | | 8/1973 | Kearney |
| 3,762,612 | A | | 10/1973 | Miller |
| 3,782,610 | A | | 1/1974 | Gilbert |
| 4,061,253 | A | * | 12/1977 | Rockefeller ..... 222/442 |
| 4,732,303 | A | | 3/1988 | Wang |
| 4,782,985 | A | | 11/1988 | Kinsley |
| 4,804,098 | A | | 2/1989 | Montgomery |
| 4,807,785 | A | | 2/1989 | Pritchett |
| 4,877,159 | A | | 10/1989 | Strand |
| 4,938,395 | A | | 7/1990 | Jamieson |
| 4,946,079 | A | | 8/1990 | Campbell |
| 5,042,698 | A | | 8/1991 | Fessell |
| 5,114,374 | A | | 5/1992 | Estiva |
| 5,145,077 | A | | 9/1992 | Rohrig |
| 5,147,072 | A | | 9/1992 | Dirksing |
| 5,238,153 | A | | 8/1993 | Castillo et al. |
| 5,273,172 | A | | 12/1993 | Rossbach et al. |
| 5,346,107 | A | | 9/1994 | Bouix et al. |
| 5,477,990 | A | | 12/1995 | Saito et al. |
| D366,809 | S | | 2/1996 | Green |
| D370,828 | S | | 6/1996 | Green |
| 5,836,364 | A | | 11/1998 | Burton |
| 5,897,013 | A | | 4/1999 | Manganiello |
| 5,927,565 | A | | 7/1999 | Paczonay |
| 5,988,448 | A | | 11/1999 | Foth |
| 6,012,617 | A | | 1/2000 | Knight et al. |
| 6,050,433 | A | * | 4/2000 | Russell et al. ..... 215/229 |
| 6,079,589 | A | | 6/2000 | Matsuyama et al. |
| 6,155,464 | A | | 12/2000 | Vachon |
| 6,170,719 | B1 | | 1/2001 | Wilkinson et al. |
| 6,230,944 | B1 | | 5/2001 | Castellano et al. |

* cited by examiner

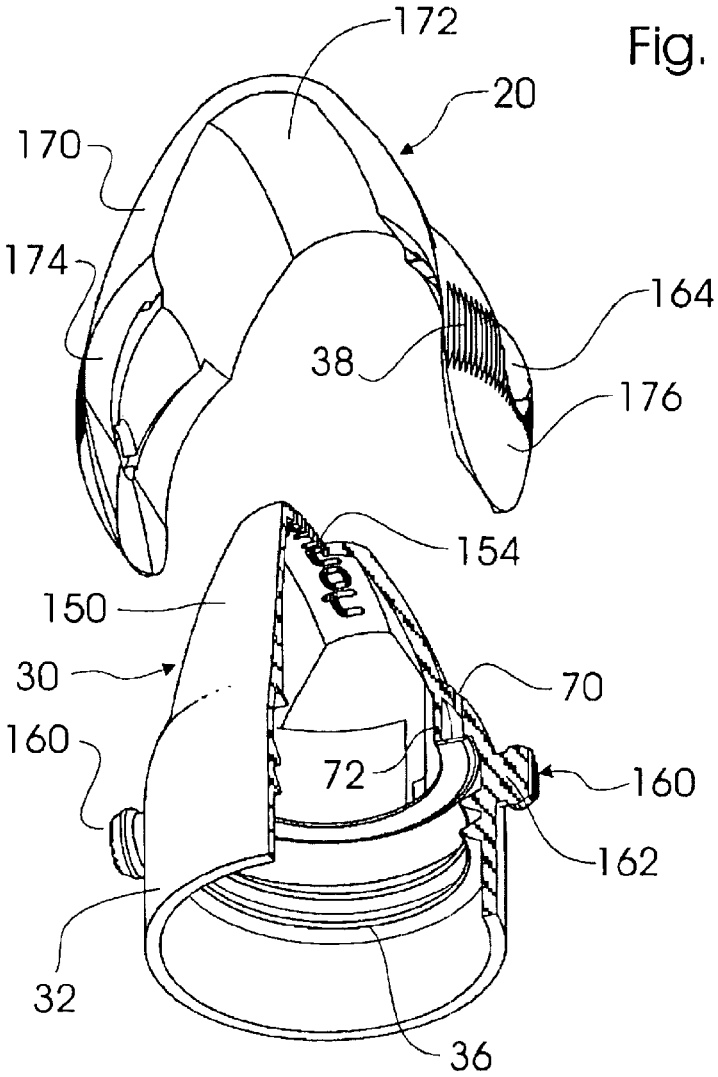
Fig. 9
Fig. 11
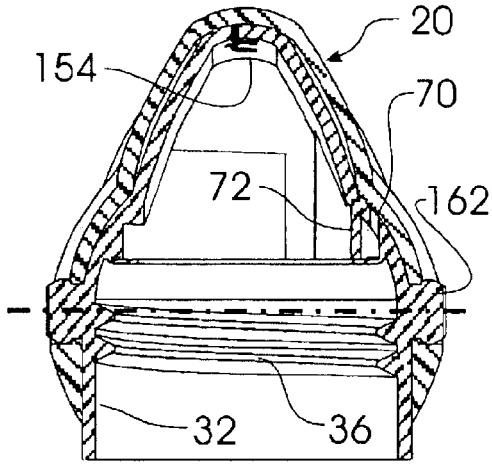

VENTED FLUID CLOSURE AND CONTAINER

CROSS-REFERENCE TO RELATED APPLICATIONS

This application is a continuation-in-part of my application Ser. No. 09/994,303, filed Nov. 26, 2001, now abandoned, entitled "Vented Fluid Container Closure", which is a continuation-in-part of my application Ser. No. 09/736,350, filed Dec. 14, 2000, entitled "Vented Fluid Container Closure", now abandoned.

FIELD OF THE INVENTION

The present invention relates generally to vented fluid closures and containers and, more particularly, to a vented closure for a fluid container with a non-pouring type fluid passage when the closure is open.

BACKGROUND OF THE INVENTION

Water and other non-carbonated beverages, and particularly sports drinks, are sold in individual servings in the form of deformable plastic bottles which are squeezable. Such bottles typically have caps in the form of a pull open/push close type closure, which typically provides a single fluid passage which is not vented. The lack of a vent in the closure causes the deformable container to collapse as a consumer draws a beverage from the container while drinking, due to a pressure differential that is created between the fluid and the exterior of the container, since the external pressure is higher as the exiting liquid causes the internal pressure to decrease. At some point during the drinking process, depending on the size of the container, no additional liquid can be withdrawn from the container until the pressure is equalized by stopping the drinking process and allowing air to rush in through the single fluid passage in the closure. This equalization can cause a reflux or backwash from the consumer's mouth into the container, which tends to contaminate the fluid in the container. Because of these problems, consumers frequently equalize pressure by holding the bottle away from the mouth and squeezing the deformable bottle in a series of squirts, with pressure equalization taking place between each squirt. This procedure often results in spills of the fluid, and results in the consumer drinking less than were it easier to dispense fluid. The lack of a vent in these closures also limits the freedom of design and materials for the container due to the fact that the deformable container must be able to collapse.

Conventional fluid containers are sometimes vented, but the vent typically is part of the container itself, and not part of the closure. Vented closures intended for pouring are known, but are undesirable for use in non-pouring type closures in which fluid will not continuously pour out of the bottle when the bottle is tilted downwardly. Sports bottles are an example of a non-pouring type closure which are intended to be left open for quick drinks during an activity, and can be easily knocked over. Furthermore, most pouring-type closures require the user to hold the container with particular orientation, often with the spout oriented downwardly for pouring, and such pouring closures are not suitable for sports bottles or the like in which the user may raise the closure without regard to any particular orientation to the closure. In general, pouring type closures are not suitable for sports bottles and other deformable containers in which the liquid exits in spurts due to squeezing of the container and/or placing the user's mouth around the closure opening to draw liquid out of the container.

Other non-pouring type closure systems have utilized a flap valve or diaphragm to regulate the equalization pressure and/or prevent liquid from leaking through vent passages for the closure. The additional components and assembly processes required to incorporate a flap valve or diaphragms or washers in a closure adds prohibitive expense and complexity to the closure. Containers designed for the application of drinking while moving are designed to allow the user to drink without tilting the head back. Such devices may use a straw to draw liquid from the bottom of an essentially rigid container and operate similar to a pouring-type container. Further, such devices may use a flap valve or other complex mechanism to vent the rigid container. Such approaches are not suitable for a standard beverage container and add prohibitive expense and complexity to the closure.

The manufacturing cost of closures used on sports drink containers and the like is critical. An increase of fractions of one cent can severely impact marketability by the closure manufacturer since consumers usually are focused on the sports beverage or supplier and are generally unwilling to pay more for the bottle and closure which contains the beverage. Likewise, it is very important that any closure should be compatible with existing bottling and assembly equipment and should be usable in connection with standard bottling and assembly processes. The types of closures proposed in the past have been incompatible with these requirements.

One objective of the present invention is to provide an improved vented fluid container closure of the non-pouring type that is adaptable to a standard beverage container.

It is another objective of the present invention to provide fluid container closures that are readily manufactured using molding and other equipment currently used for beverage container closures and which are easily adaptable to current beverage filling and processing equipment.

It is a further objective of the present invention to solve the problem of contamination of fluid while drinking due to reflux in a squeezable plastic container which dispenses liquid in squirts when held overhead in no particular orientation.

It is yet another objective of the present invention to provide improved push-pull type closures and improved flip-top rotatable type closures that allows drawing of fluid out of containers and provide new closure features adaptable to standard beverage filling and processing equipment.

It is still another objective of the present invention to provide a liquid closure that is vented to air and has vent passageways that self-seal using the surface tension of liquid in direct liquid contact with one or more vent apertures and which eliminates valves, flaps and other sealing mechanisms.

SUMMARY OF THE INVENTION

In order to achieve the foregoing objectives, the vented closures of the present invention provide non-pouring type closures with a fluid passage and one or more vent passages of predetermined dimensions and placement in an annular collar adaptable to a standard beverage container. The fluid passage and the one or more vent passages may be opened and closed by the same cap. When the cap is open and inverted to a drinking position, surface tension of the liquid will seal the one or more vent passages which are in direct contact with the liquid, and eliminate special sealing structure previously necessary for the vent passageways. The vent openings are sufficiently small size and placement relative to the main fluid exit so that the weight of the liquid which is in direct contact with the vent openings does not exert sufficient force to overcome surface tension and substantially prevents equalizing air from entering the vent passageways. The resulting pressure differential prevents liquid from exiting the bottle during equilibrium even when the closure is open and inverted.

When liquid is drawn out a main liquid passageway, as in the act of drinking due to squeezing the container and/or sucking on an open cap, sufficient additional force is applied to overcome the surface tension sealing the vent apertures, and equalizing air is drawn into the vent passage for as long as the drawing force is present. When the drawing force is removed, the surface tension of the liquid substantially reseals the vent and allows only a few drops of liquid to exit before differential pressure stops the flow.

The air entering the vent passageway is desirably separated from the flow of exiting liquid by a divider to prevent the air from becoming entrained. Several embodiments for the dividers are disclosed which are sufficiently open in configuration to allow the self-sealing action during equilibrium, and when a destabilizing force is present permits entry of air while minimizing interaction between the air entering the container and liquid exiting the container.

Certain embodiments consist of push-pull type caps that engage an annular collar. The cap is movable along the collar between open and closed positions, and when in the open position, the vent passage and fluid passage are both open. A divider which isolates the equalizing venting, air from the exiting fluid can take several forms which generally are partially open in profile such that the more open portion is opposite the main fluid passageway.

Other embodiments consist of flip-type caps of generally U-shape which rotate about a pivot base. One or more air vents formed on one side of the rotatable cap can take several forms which each provide direct liquid contact of sufficiently small size and placement to self-seal when the liquid in the container is in equilibrium with outside pressure. A divider which isolates the equalizing venting air from the main fluid flow can take several forms including a curved or serpentine path.

BRIEF DESCRIPTION OF THE DRAWINGS

The operational features of the present invention are explained in more detail with reference to the following drawings, in which like reference numerals refer to like elements, and in which:

FIG. 9 is an exploded bottom perspective view of second embodiments of the novel vented closure attachable to a deformable beverage container;

FIG. 11 is a side cutaway view of the embodiment of FIG. 10 with the cap rotated to a closed position;

DETAILED DESCRIPTION OF THE PREFERRED EMBODIMENTS

Figure 1:
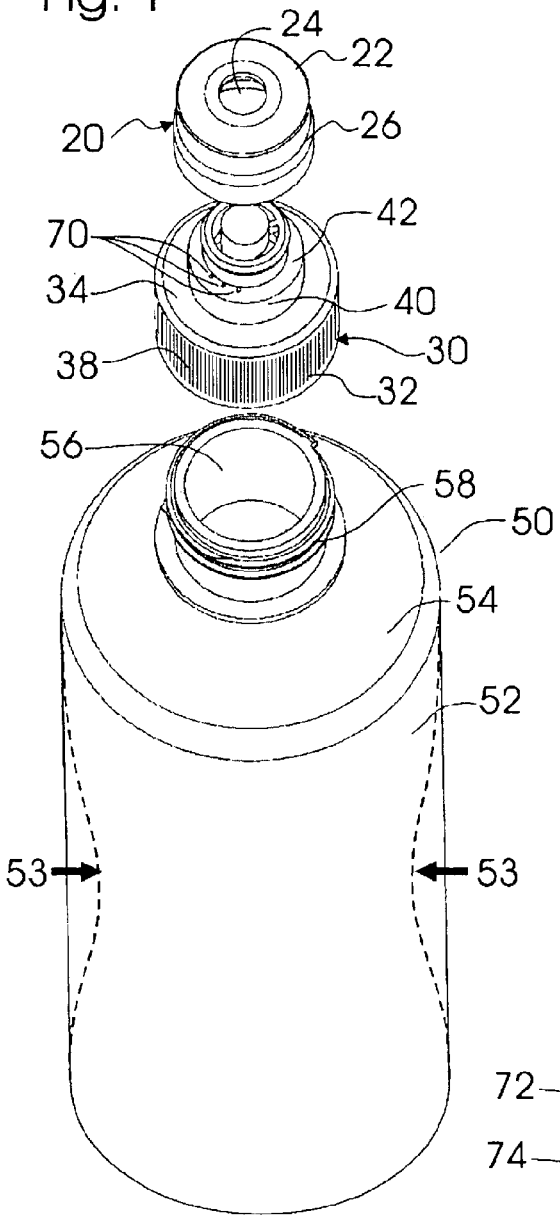
FIG. 1 is an exploded top perspective view of first embodiments of the novel vented closure attachable to a deformable beverage container.

Turning to FIGS. 1 to 6, a first embodiment of the vented fluid closure and container of the present invention can be seen. The closure consists of two molded parts 20 and 30 which move relative to each other to create a push-to-close and pull-to-open or push-pull type closure.

One molded part which forms the closure consists of a cap 20 which includes a top planar surface 22 containing a central circular aperture or bore 24 for the passage of fluid. An annular skirt 26 extends downwardly from the top 22 to define an open interior space. A rim or lip 28 extends around the periphery of the top surface 22 to provide a convenient surface for a user to grasp the cap for pull movement upwardly to move the cap to an open position or for a push movement downwardly to a closed position.

The second molded part which forms the closure consists of a base annular collar 30 which can be secured to a beverage container. In one preferred embodiment, the collar 30 consists of a series of increasingly smaller diameter and connected annular rings and shelves. A first bottom annular ring of the greatest diameter is formed by a first side wall 32 extending in a longitudinal direction and terminating in a top annular shelf 34 with an upright annular rim 35. The shelf 34 extends radially inward from the annular rim 35. Side wall 32 has an interior surface which includes interior threads 36 for mating engagement with a beverage container. Side wall 32 has an exterior surface which includes a large plurality of vertical ribs 38 which are engagable by standard packaging machinery for filling the containers during manufacture to provide gripping surfaces to assist in threading the interior threads 32 onto the beverage container after the container has been filled. These external ribs 38 also assist the user in attaching or detaching the closure from the container.

A second annular ring of intermediate size consists of a second side wall 40 which mates with the shelf 34 and extends longitudinally upward to a top annular shelf 42 which is slightly tapered. The annular shelf 42 extends generally transversely inward and slightly upward to mate with a third or top annular ring having the smallest diameter.

Figure 3:
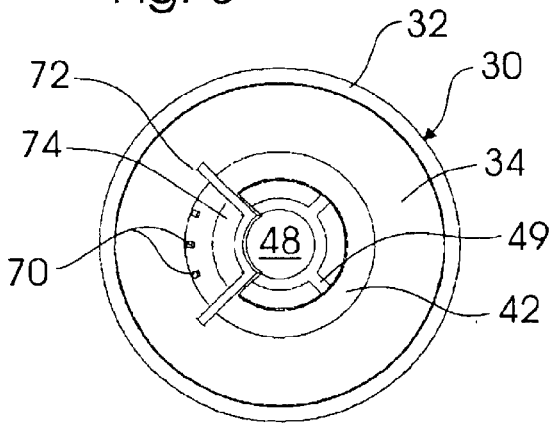
FIG. 3 is a bottom view of the vented closure shown in FIGS. 1 and 2.
Figure 4:
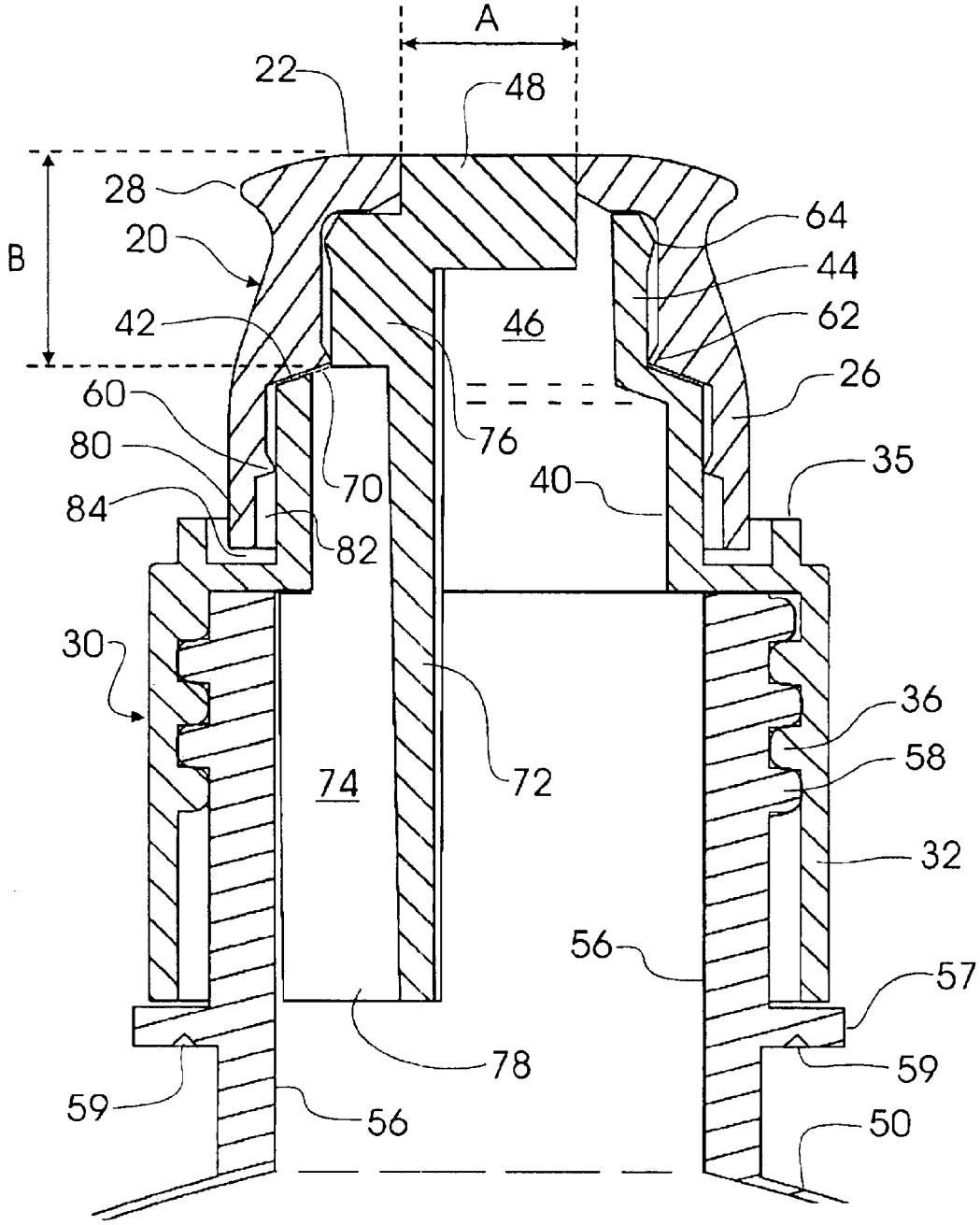
FIG. 4 is a side cutaway view of the vented closure of FIGS. 1 to 3 in a closed position and assembled on the container.

A top annular ring includes a third side wall 44 seen best in FIG. 4 which generally surrounds an interior fluid passageway 46. The third ring includes a circular stopper plug 48 connected via struts 49, see FIG. 3, to the third ring side wall 44. The stopper plug 48 is located in the center of the third annular ring which generally surrounds the circular plug 48. The center plug 48 is located so as to slidably engage and mate with the circular bore 24 when the cap 20 is moved to the closed position seen in FIG. 4. In this closed position, the surfaces of the stopper plug 48 will block the fluid passageway 46 and prevents liquid in the container from exiting the closure. As will appear, the cap 20 surrounds and moves upwardly and downwardly relative to the second and third rings including the side walls 40 and 44.

The base collar 30 and the cap 20 which is slidably captured thereon are adapted to mate with a standard fluid container 50 which may be any container for containing a fluid, such as a bottle for a single serving of a liquid sport drink or water. The beverage container 50 preferably has thin plastic side walls 52 which are squeezable or deformable along arrows 53 in order to increase pressure within the closed container when liquid is to be dispensed from the container. The container 50 forms a closed vessel having deformable side walls, a bottom wall, and a top wall 54 having an upright annular neck 56 which is hollow and serves as the sole opening for the passage of fluid out of the container.

The upright annular neck 56 includes an annular rib 57, see FIG. 4, and located above the ribs 57 are external threads 58 for mating engagement with the internal threads 36 of the base collar 30. A bottom surface of the annular rib 57 includes small indents 59 which are caused by standard packaging machinery during filling of the container to prevent rotating of the container as the base collar 30 is rotatably threaded onto the container after filling.

Figure 2:
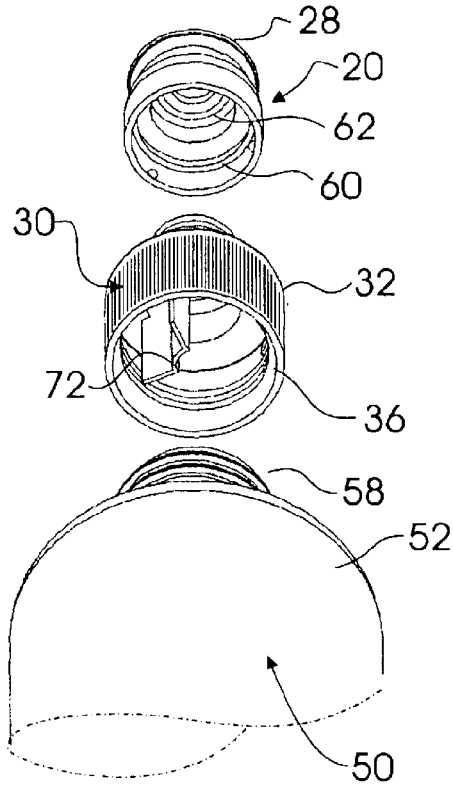
FIG. 2 is an exploded bottom perspective view of the embodiment of FIG. 1.

The cap 20 can slide in a tight, frictionally-sealing motion along the second and third rings of the base collar 30 to open and close the closure. As seen in FIGS. 2 and 4, the cap 20 includes a lower interior annular ridge 60 and an upper interior annular ridge 62 which encircle the interior skirt wall 26 of the cap. The cap 20 can be slidably pushed downwardly by a user to a fully retracted or closed position with respect to the base collar 30, as seen in FIG. 4. The cap circular bore is then sealed by the stopper plug 48 which blocks the fluid flow passage 46 which leads into the open interior of the upright container neck 56.

Figure 5:
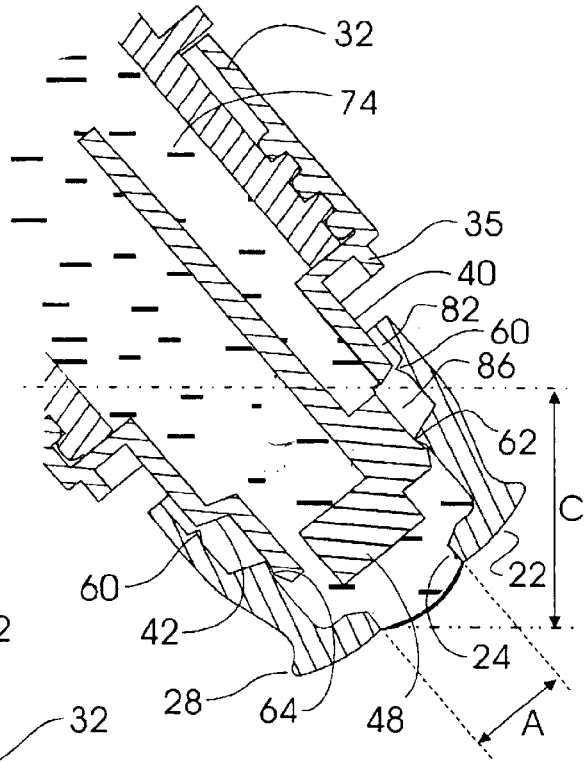
FIG. 5 is a side cutaway view of the vented closure of FIGS. 1 to 3 in an open self-sealing position in equilibrium and without drawing forces present.
Figure 6:
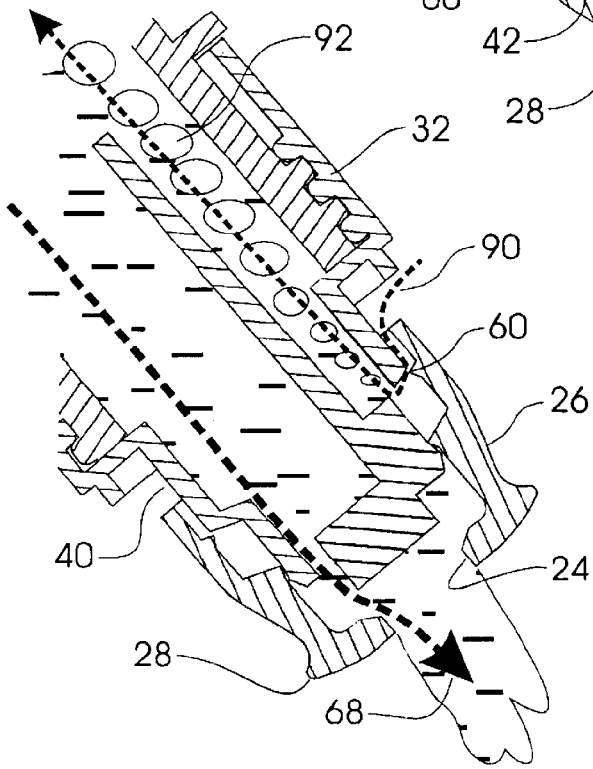
FIG. 6 is a side cutaway view similar to FIG. 5 but with drawing forces present to cause liquid flow and air venting of the closure and container.

To open, a user pulls longitudinally upward to slidably move the cap 20 along the second and third rings of the collar 30 to an open position as seen in FIGS. 5 and 6. The side wall 44 of the third ring includes a flaring rim or stop 64 which engages the cap upper annular ridge 62 to stop further outward movement and thus capture the slidable cap 20 to the base collar 30. The upward pull moves the cap circular bore 24 out of engagement with the stopper plug 48, and thus opens the fluid passageway 46 so that the liquid in the container can be disbursed along a fluid passageway shown by the arrow 68 in FIG. 6. To disburse liquid, the container side wall 52 is squeezed along the direction of the arrows 53, and/or the user can place his or her mouth over the cap 20 while the container is tilted overhead as seen in FIG. 6 and suck on the cap 20 to create a vacuum so that there is a pressure differential to cause liquid from the container to exit along the arrow path 68.

Preferably the cap 20 and base collar 30 are each molded as a single piece of plastic. For example, cap 20 can be injection molded of low density polyethylene (LDPE) or PPL, but any suitable material may be used. The base collar 30 is preferably a one piece injected-molded material, such as high density polyethylene (HDPE) or polypropylene (PPL), but any suitable material may be used.

To the extent described above, the cap 20 and base collar 30 are generally of known construction and form a non-pouring, push-pull type closure for squirting or dispensing liquid in bursts out of a standard deformable beverage container 50. As will now be described, the closure has been modified to provide a unique vented closure which solves numerous problems with prior closures for non-pouring type liquid containers. Furthermore, these modifications are adaptable to existing molding as well as assembly and filling machinery so as to minimize the cost of providing a vented closure for a liquid container.

One or more small diameter vent apertures 70 are located in a middle region of the collar 30, such as in the second ring shelf 42, see FIGS. 1 and 3, and extend through the shelf 42. Each vent aperture 70 is of a small cross-sectional area and location selected to perform self-sealing by surface tension of liquid in contact with the aperture 70. Both the cross-sectional area and the location of the vent aperture relative to the fluid dispensing opening are selected as will be explained in connection with FIGS. 8*a* and 8*b* to create a self-sealing feature. Each vent aperture 70 should be spaced sufficiently apart so as to operate independently of other vent apertures as to the self-sealing function. More than one vent aperture 70 is useful to increase venting air flow into the container and to prevent possible clogging due to dust or small debris, and three vent apertures are illustrated by way of example.

A divider baffle 72 extends through the hollow interior of the base collar 30, and is spaced from the side walls 32 and 40 by a sufficient distance to create a secondary liquid passageway 74 for conveying liquid from the container into direct contact with the vent apertures 70 when the container is tilted. The longitudinally extending divider 72 attaches at its upper end 76 to the third ring side wall 44, see FIG. 4. The divider lower end 78 is open and is shown generally flush with the bottom of the first side wall 32. The divider 72 has a generally W-shaped cross-section as seen best in FIG. 3. The two legs of the W-shape are spaced away from the first side wall 32 sufficiently to allow the container neck 56 to be intermeshed therebetween, as seen in FIGS. 3 and 4, and create a pair of spaced side openings for air and liquid flow. The generally open liquid passageway 74 leads from the open bottom 78 upwardly without obstruction into direct contact with the vent apertures 70. It is important that no obstructions, seals, washers or the like block the fluid passageway 74 which must allow liquid to freely contact the vent apertures 70. The liquid passageway 74 is a secondary fluid passageway separate from the primary fluid passageway 46 which extends through the entire closure.

When cap 20 is closed and fully retracted down along the base collar 30, as seen in FIG. 4, each vent aperture 70 is sealed by several mating surfaces. The tapered annular shelf 42 abuts the cap, and the cap lower ridge 60 is in tight contact with the second side wall 40.

Cap 20 includes a lower skirt 80 beneath the lower ridge 60 which is spaced radially outward and forms an air passageway 82 underneath the skirt 80. This air passageway 82 is contiguous with a third air passageway 84 formed under the bottom edge of the skirt 80 and which bends upwardly inside the rim 35 and is open to external air.

As the cap 20 is pulled outward, the cap upper ridge 62 slides along the collar side wall 44, and the cap lower ridge 60 slides along the collar side wall 40, until reaching a fully open position as seen in FIG. 5. When fully open, the cap upper ridge 62 engages the collar rim stop 64 and prevents further movement of the cap.

Importantly, the cap lower ridge 60 is located to clear contact with the second side wall 40 and opens a narrow annular gap as seen in FIG. 5. As a result, external air can travel under the skirt 80 and via the air passageways 84 and 82 into an air chamber 86 formed between the cap skirt and the third side wall 44. This supplemental air chamber 86 is in direct contact with all air vents 70 to convey external air under the cap skirt and directly into contact with all air vents 70. However, air does not initially pass into the interior of the base collar, because each air vent 70 is effectively sealed by the surface tension of the liquid in contact with it, as illustrated in FIG. 5.

The relationship which creates the self-sealing action by surface tension will be further explained in connection with FIGS. 8*a* and 8*b* and is dependent upon certain dimensions and locations of the components forming the closure. To explain the relationships, certain parts have been labeled with reference letters. The diameter of the primary fluid passageway is labeled A, see FIGS. 4 and 5, and in one specific embodiment was 0.30 inches. The fixed height between the fluid aperture 24 formed in the top surface 22 and the location of the vent aperture 70 is labeled B in FIG. 4, and in the one specific embodiment was 0.46 inches in the open position. For this one specific embodiment, each aperture 70 was circular and of a diameter of 0.03 inches.

When the closure and container is tilted to dispense liquid, the effective column height of liquid between vent aperture 70 and dispensing aperture 24 increases as seen in FIG. 5. An offset C represents a distance or height between the top of the vent aperture 70 when in contact with fluid in the secondary fluid passageway and the bottom of the primary fluid passageway opening 24. Offset C represents the hypotenuse of a triangle having a fixed dimension B as one side with the variable dimension C being dependent on the angle of tilt of the closure and container. An additional column of liquid is above the vent aperture 70, as well as above the dispensing aperture 24, but is supported by a partial vacuum at the upper portion of the tilted container 50. When formed to be self-sealing, the potential energy of the liquid column C is insufficient to overcome the coefficient of surface tension which seals both the vent opening 70 and the fluid aperture 24. Thus, when at equilibrium as illustrated in FIG. 5, liquid within the tilted container does not escape through the vent aperture 70 which is self-sealed by surface tension, nor the primary dispensing aperture 24 which is retained by a pressure differential.

As a pressure differential is created by a user placing his or her mouth over the cap 20 and sucking to create a vacuum, liquid in the tilted container will flow in a squirt or burst through the primary fluid passageway 46 along the direction of the arrow 68 in FIG. 6. At the same time, venting air will pass along the dotted lines 90 from outside the cap and under the skirt into air passageways 82 and 86 and then through the vent aperture 70 and into the secondary liquid passageway 74. The resulting air bubbles 92, which are not to scale, will travel through the liquid passageway 74 and into the container to vent the container to external air.

Liquid will continue to be dispersed from the container and venting air will continue to flow into the container as seen in FIG. 6 until the external destabilizing force is removed. After a short time such as one second or so after removal of the destabilizing force, equilibrium will be established and conditions will return to the steady state condition illustrated in FIG. 5. That is, the surface tension of liquid will self-seal both the dispensing opening 24 and the vent apertures 70 and the passage of liquid and air through the apertures will cease even though those apertures are open. To overcome this equilibrium or steady state condition, the user needs to again create an external destabilizing force which overcomes the surface tension of liquid at the apertures 70 and 24.

Figure 7A:
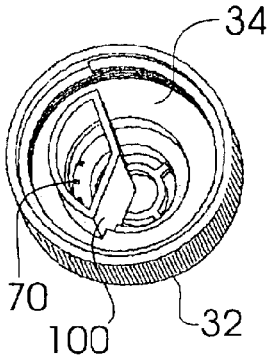
FIGS. 7*a* to 7*c* are bottom perspective views of alternate dividers usable with any of the closures.
Figure 7B:
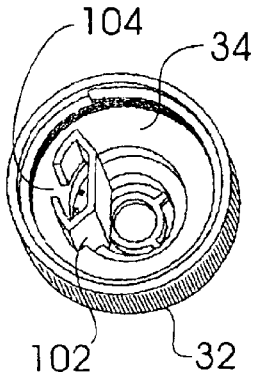
Figure 7C:
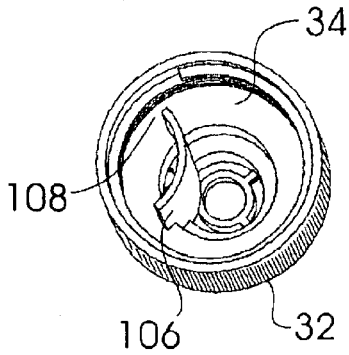
Figure 13:
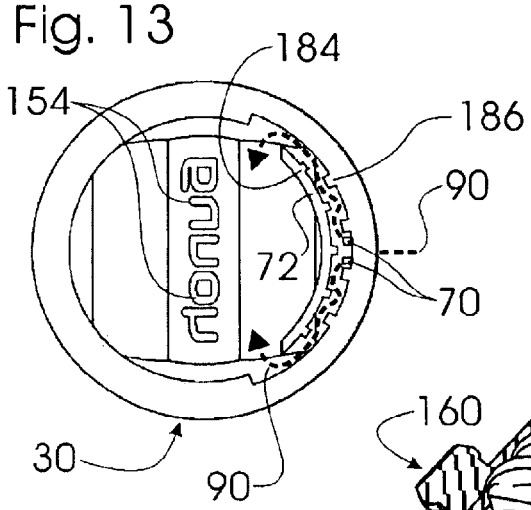
FIG. 13 is a bottom view of the closure of FIGS. 9 to 12 and showing an alternate embodiment for a divider with a serpentine venting air path.

The divider 72 can take a variety of other configurations such as seen in FIGS. 7*a* to 7*c* and in FIG. 13. For example, the divider can be in the form of an enclosed riser tube 100 as seen in FIG. 7*a*. The riser tube 100 consists of wide V-shaped walls near the center and an arcuate end which is parallel with the arcuate inside first side wall 32. One advantage of an enclosed riser tube is that venting air will not escape around the sides of the baffle and into the primary liquid passageway 46, but the shape is more complex to mold. Alternatively, the divider can be in the shape of a partially enclosed baffle 102, FIG. 7*b*, which has an open slot 104 partially or totally along a section furthest removed from the main fluid passageway. While venting air will escape through the open slot 104, the location of the slot is farthest away from the primary liquid flow path nearer the center of the closure. Another form of divider is a wall 106 as seen in FIG. 7*c*, which can be either planar or curved as illustrated, with sides extending toward and spaced from skirt wall 32 to allow venting air to escape through a pair of gaps 108 to each side of wall 106 as well as to escape through the bottom of the wall. Such a divider 106 has advantages in terms of ease of molding.

Each divider 72 in FIGS. 2–4 and 13, and each divider 100, 102 and 106 in FIGS. 7*a* to 7*c*, is designed for allowing venting air to pass with minimal intermixing with the primary liquid passageway, without vapor lock which could cause problems due to the entrapment of bubbles. Each divider is preferably asymmetrically formed to one side of the central interior space and in closer proximity to one side of the upright container neck, so as to guide the flow of venting air away from the main liquid flow which passes primarily through the open central region of the collar 30.

As the offset length C between the cap top 22 and the vent apertures 70 increases, the diameter D and/or the cross-sectional area of the vent openings 70 must decrease in order to maintain self-sealing by surface tension of the liquid. The vent apertures 70 in FIG. 1 could be located, for example, on the first ring such as on the shelf 34, but this requires a very small diameter vent aperture 70 in order to maintain a self-sealing relationship. A very small diameter opening is more apt to be blocked by dust, dirt and other conditions. Conversely, the vent apertures 70 could be located on the upper third ring such as on the side wall 44 seen in FIG. 4. But it is more feasible for molding purposes to locate the vent aperture 70 on one of the generally horizontal ring shelves. A location on the second ring, and desirably on the shelf 42, provides a good balance between the size and location of the air vent 70 while maintaining the self-sealing properties.

Figure 8A:
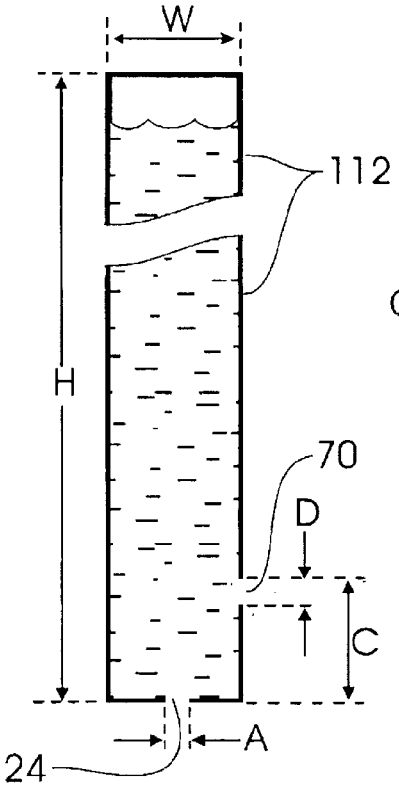
FIG. 8*a* illustrates test apparatus for determining the size and locations of the vent apertures relative to the liquid dispensing aperture.

FIG. 8*a* shows test apparatus used to determine the relationships regarding one or more vent apertures 70 and the main fluid dispersing opening 24. A tubular container 112 of PVC plastic having rigid sides was constructed of a height H and an internal diameter W, and was sealed at both ends. A liquid dispensing bore 24 was drilled of various diameters A. One or more vent apertures 70 were drilled into the plastic tube 110 at various heights which correspond to dimension C, i.e., the offset distance between the liquid dispensing opening 24 and the top of the vent aperture 70. Also, the vent aperture 70 was formed with several diameters D.

In one set of tests, the container 112 had a height H of approximately 10 inches and a diameter W of approximately 1 inch. A total of sixteen small diameter vent apertures 70 were drilled, each at 0.100 inch spacing from the bottom end of the container. To provide sufficient distance between each test aperture, the sixteen vent apertures were located along a spiral path around the external diameter of the tube so that each vent diameter could be drilled to a larger diameter. Vent holes 70 initially were all of the same 0.025 inch diameter. All sixteen holes were covered to form an airtight seal. The container 110 was filled with water. The apparatus was oriented with the dispensing opening 24 at the bottom as illustrated in FIG. 8*a*. No liquid was then being dispensed through the opening 24. Next, each vent 70 was exposed one at a time from the bottom up. As the first fifteen vents were exposed to air, no liquid escaped through the dispensing bore 24 which remained self-sealing by surface tension. When the sixteenth vent was uncovered at a vertical height of about 1.6 inch, venting air began to flow into the interior of the sealed container 112 and water was dispensed through the dispensing bore 24. Thus, above a maximum value for C, the vent aperture 70 would allow air bubbles to flow into the container 112 so that the container became a pouring-type container which no longer would self-seal by surface tension of liquid.

In other tests, the container 112 had a height H of 8.25 inches and a diameter W of 1.0 inch. The dispensing opening 24 had a diameter A of 0.125 inches for one set of tests, and 0.250 inches for another set of tests, and 0.315 inches for further tests. It was determined that the fluid dispensing opening 24 can be varied in diameter A within a range without affecting the self-sealing feature.

However, once the diameter A is greater than approximately 0.4 inches, the fluid opening 24 will self-vent and admit air through the opening 24 itself. Thus, the primary liquid dispensing opening 24 preferably should be less than about 0.4 inches in diameter, or less than an equivalent cross-sectional area if the liquid dispensing opening 24 is irregular in shape.

The term equilibrium means that a flow of liquid will stop in a short time, such as less than one second, after an external disabling force is removed. The term non-pour means that when a container is inverted, with the vent aperture obstructed and also with the vent aperture open, the same amount of liquid will escape the closure before it reaches a static state.

Figure 8B:
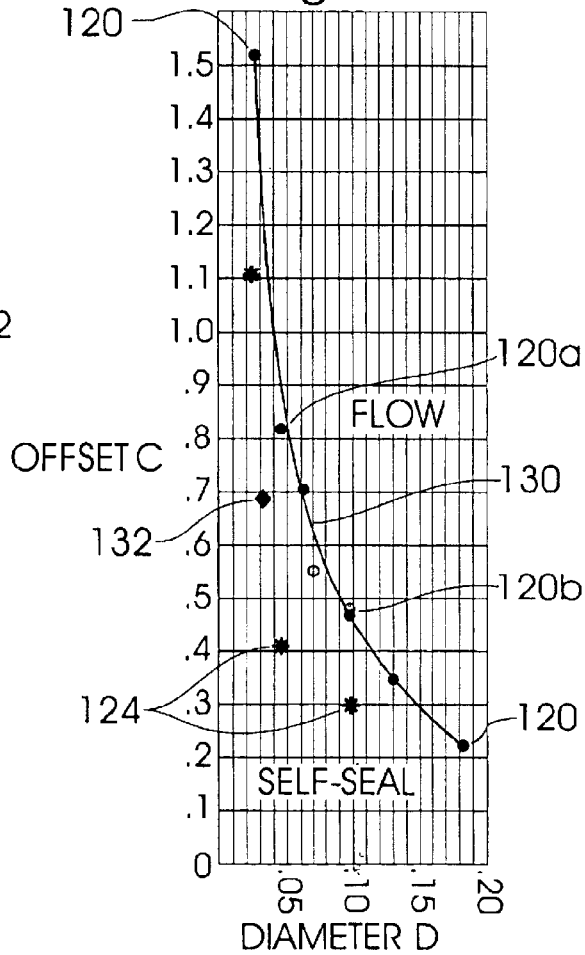
FIG. 8*b* is a chart showing the results for certain test apparatus and for the FIGS. 1 to 6 embodiment.

FIG. 8*b* is a graph which plots the results of several experiments and also illustrates the relationship between the offset C and the diameter D for these experiments and the FIGS. 1 to 6 embodiment. A vertical axis labeled offset C represents the offset height in inches from the liquid dispensing bore 24 to the top of the venting aperture 70, e.g. see FIG. 8*a* and FIG. 5. A horizontal axis represents the diameter D in inches of various vent apertures 70. Each of the dots 120 represent a point of transition between a self-sealing closure versus a flow/pouring type closure for a particular liquid and closure material. For example, point 120*a* shows that a vent aperture 70 of diameter 0.05 inches was self-sealing by surface tension when located in a desired range from 0 to about 0.82 inches above the liquid dispensing aperture 24. When this same vent diameter of 0.05 inches was located by an amount greater than 0.82 inches above the liquid dispensing aperture 24, then venting air would enter through the vent aperture 70 and liquid would flow out of the dispensing opening 24. As another example, point 120*b* show that a vent aperture 70 of diameter 0.10 inches was self-sealing by surface tension when located in a desired range from 0 to about 0.48 inches above the liquid dispensing aperture 24. Two overlapping dots 120*b* are illustrated which represent two different experiments in which the results were essentially the same for water at room temperature. When the vent aperture of diameter 0.10 inches had an offset C greater than about 0.48 inches, the liquid surface tension would rupture and air would undesirably flow through aperture 70 causing liquid to flow through aperture 24.

The points 120 and 124 in FIG. 8*b*, which represent the points of transition between a self-sealing closure and a pour closure, are also summarized below in the following Table A. In this Table A, the offset C listed thus represents the maximum length possible to maintain self-sealing by surface tension for each listed vent diameter.

TABLE A

| Vent Diameter | Maximum Offset C | |
|---|---|---|
| D | Liquid 1 | Liquid 2 |
| 0.03 | 1.51 | 1.11 |
| 0.05 | 0.82 | 0.42 |
| 0.06 | 0.70 | |
| 0.07 | 0.55 | |
| 0.10 | 0.48 | 0.29 |
| 0.13 | 0.35 | |
| 0.18 | 0.22 | |

Liquid 1 is water at room temperature, and the resulting plots for dimensions C and D are shown in FIG. 8*b* by dots 120. Liquid 2 is water with a soap surfactant added to reduce surface tension, and the resulting plots are shown by star symbols 124 in FIG. 8*b*. The weight of soapy liquid which could be supported was reduced by about half or more due to a reduction in surface tension. All dimensions in Table A are given in inches and have been rounded off to the nearest 0.01 inch.

When the different test points for liquid 1 in Table A are plotted, the resulting dots 120 form a curve 130 seen in FIG. 8*b*, which starts somewhat linear for small diameters D and becomes more arcuate for larger diameters D. All intersections above the curve 130 are labeled "flow" because vent apertures of corresponding diameter D and offset C would allow air to continuously bubble through the venting apertures 70 and cause liquid to flow from the dispensing aperture 24. Such a combination effectively creates a pouring dispenser. All intersections below the curve 130 are labeled "self-seal" because vent apertures of corresponding diameter D and offset C would allow the vent apertures 70 and liquid dispensing aperture 24 to self-seal by surface tension while the container was at equilibrium. Thus, the many combinations of vent diameters D and offset amounts C located below curve 130 in the "self-seal" region represent the ranges of dimensions to be used to create the novel vented closures of the present invention.

For containers designed to hold other liquids, a plot can be made of test points to produce a curve similar to curve 130 in order to establish the desired combination of vent diameters D and maximum offsets C to create apertures 70 and 24 which will self-seal by surface tension for the specific liquid to be stored in the container. Thus, the placement and size of the vent apertures 70 in the base collar 30 can be empirically determined for the liquid to be dispensed. As vent apertures 70 are moved further away from the dispensing bore 24, the diameter or cross-sectional area of each vent aperture must be decreased in order to maintain a self-sealing relationship using the surface tension of the liquid in the container.

The dispensing aperture 24 and the vent apertures 70 can have shapes other than circular. The dispensing aperture 24 shown in the embodiments of FIGS. 9 to 13 are of irregular shape which can form words and/or symbols. While the vent apertures 70 can be shapes other than circular, due to their small size, a circular bore is generally easiest to form and manufacture.

To allow for manufacturing tolerances and material variations, it is preferable to select dimensions for C and D which are spaced away from the transitional curve 130 which is the dividing line between a self-sealing closure and a flow closure. For example, the following Table B provides the dimensions in inches for one specific embodiment for the closure of FIGS. 1 to 6 which is self-sealing by surface tension.

TABLE B

| Dimension | Inches |
|---|---|
| A | 0.30 |
| B | 0.46 |
| C[1/] | 0.68[1/] |
| D | 0.03 |

[1/]Calculated for 40°

The calculated dimension C of 0.68 inches represents a tilt angle of about 40°, and is close to the maximum offset to be experienced when water is to be dispensed from the tilted container 50 seen in FIGS. 5 and 6. The dimensions C and D in Table B are plotted in FIG. 8*b* as a diamond point 132. This point 132 is spaced away from the transition curve 130 by a desirable amount, and falls with the self-seal region of FIG. 8*b*.

The dimensions given in Table B can be varied so long as the dimensions plot away from the transition curve 130 and fall within the self-seal regions of FIG. 8*b*. For example, it has been found preferable considering human factors and a closure which is within typical commercial standard sizes for the offset height C to be within a predetermined range from about 0.4 to 0.9 inches. Furthermore, a desirable range for the vent diameters is less than 0.10 inches, and preferably from 0.09 to 0.03 inches or an equivalent cross sectional area. Other ranges can be determined following the methodology set forth above. FIGS. 9 to 13 show additional embodiments for a cap 20 movably mounted relative to a base collar 30 and having one or more vent apertures 70. These embodiments utilize a rotating cap 20 which can be flipped by one hand operation, as contrasted to a slidable push-pull cap as in the prior embodiments.

Figure 12:
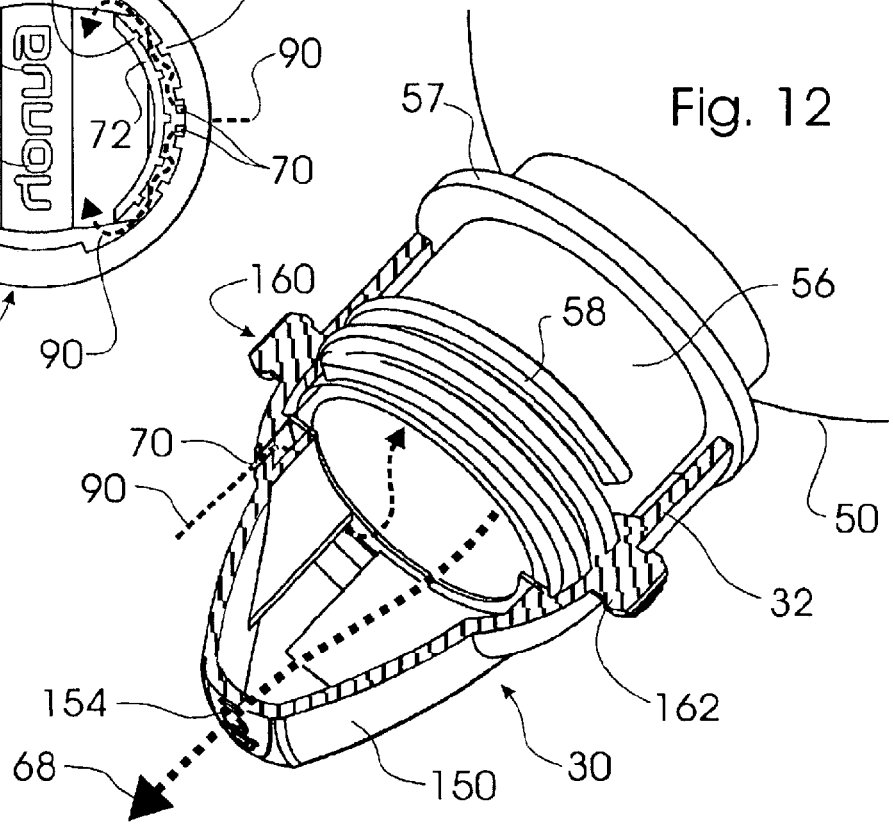
FIG. 12 is a perspective view of the FIGS. 9 to 11 embodiments showing the base collar partly in section and assembled on the container, with the rotatable cap removed for clarity, and with drawing forces present to cause liquid flow and air venting of the closure and container.

Base collar 30 includes a lower annular ring having a side wall 32 with internal threads 36 for screwing attachment to the external threads 58 on the upright neck 56 of the fluid container 50, see FIG. 12. The side wall 32 extends inward and then upwardly to a raised central neck 150 having a generally tapered and rectangular shape. Rather than a single liquid dispensing opening, a series of dispensing openings 154, each separated by a ridge, allow a larger total opening area on the top of neck 150. Each opening 154 is spaced sufficiently apart by a ridge or wall so as to operate separate and independently of the other multiple dispensing openings 154 to allow surface tension to form. Desirably, the plurality of liquid dispensing openings 154 can be shaped to form a trademark, symbol, or word for advertising or other purposes as seen best in FIG. 13. In the illustrated example, five separate openings 154 form the word YOUNG when viewing the base 130 from the top (such as above the FIG. 10 drawing). The use of multiple separated dispensing apertures 154 forming a trademark or word or a symbol is desirable in self-sealing closures as well as in pouring closures. The raised central neck 150 is shaped so that it can be formed by two halves of a mold without the necessity for retracting slides within the mold.

Figure 10:
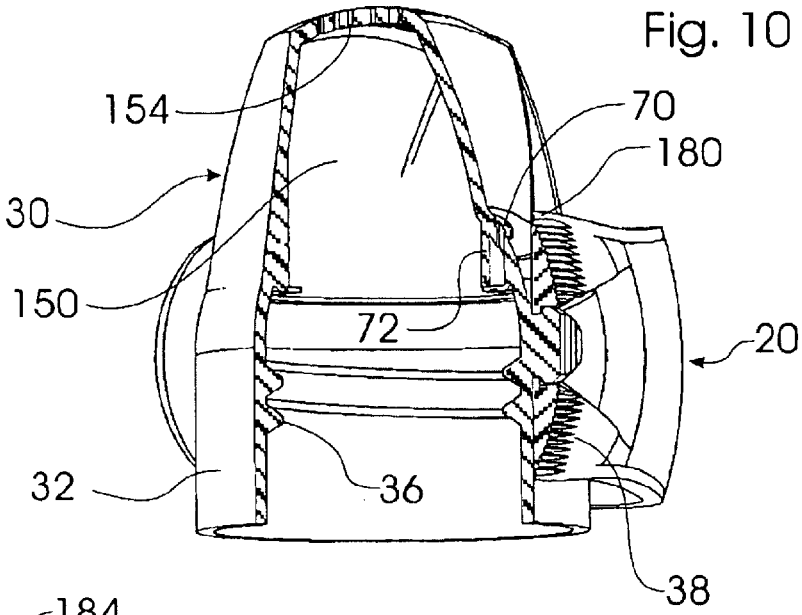
FIG. 10 is a side perspective view of the FIG. 9 embodiments when assembled with the cap rotated to an open position.

Near the bottom of the central neck are a pair of pivot pins 160, each extending outwardly from the side to form an axis for the rotatable cap 20. Each pivot pin 160 includes an enlarged head 162 and a neck of reduced diameter. A pair of circular bores 164 in the cap 20 can be snap fit over the pivot heads 162 during assembly of the closure. As seen in FIG. 10, the enlarged heads 162 increase the bearing surface so that the cap 20 can be smoothly rotated about the pivot axis 160.

Cap 20 is formed of a generally U-shaped cover 170 having a central bight 172 and a pair of extending legs 172 terminating in circular disks 176 each containing the circular bearing holes 164. The cap cover 170 can rotate between an open position, as seen in FIG. 10, and a closed position as seen in FIG. 11 which blocks the dispensing openings 154 by the cover 170. Each of the legs 174 contain a series of ribs 38 which extend vertically upright when the cap 20 is closed so as to be engagable by standard packaging machinery to provide gripping surfaces to assist in threading the interior threads 32 onto the beverage container after it has been filled. These external ribs 38 also assist the user in screwing the closure onto and off of the container 50.

Various modifications can be made to the cap 170 if desired to provide additional features. For example, a resilient compliant sealing material such as food grade polyvinyl chloride (PVC) can be molded or inserted into an inner surface of the bight 172 (not illustrated). To further improve sealing of the main liquid passageways 154 when in the closed position, the top bight 172 of the U-shaped cover 170 can have an angled shape for the respective mating surfaces of the rotating cap and the top surface of the central raised portion 150. By way of example, an inner surface 172 of the cap can form a ramp angle from a tangent of a swing arc, such as an angle between seven degrees and fifteen degrees. Such a ramped surface (not illustrated) would create a positive seal stop as the cap 20 is rotated to a closed position.

One or more vent apertures 70 are located in the collar 30. In the illustrated embodiments, a pair of vent aperture 70 are utilized, each of which has a small area and is offset relative to the dispensing openings 154 so as to fall within the self-seal region of FIG. 8*b*. Each vent aperture 70 is formed vertically as a small diameter bore through the raised central neck 150. Each aperture 70 directly opens behind a generally flat divider 72 which forms a secondary liquid passageway to one side of the collar 30. Each circular bearing hole 164 includes a skirt region 180 which covers the vent opening 70 when the cap 20 is rotated the open position, as seen in FIG. 10. This overlap is desirable to prevent dirt and dust from entering the vent apertures 70, and also serves to prevent the vent apertures 70 from being covered by a user's lips when tilting the container as seen in FIG. 12 to allow liquid to flow along the arrow 68 through the dispensing openings 154.

As seen in FIG. 13, the divider 72 can be modified to include a plurality of projecting divider ribs 184 to create a circuitous air path 90 for the venting air. The interior surface of the cap 30 can include offset ribs 186 spaced from the divider ribs 184 so as to form a serpentine or wavy path for the venting air 90. Such a serpentine path breaks up any smooth flow of venting air and assists in minimizing the creation of air bubbles flowing into the central dispensing region of the closure. The divider of FIG. 13 can be used with the push-pull closure of FIGS. 1 to 6 to disperse venting air and thereby minimize the effect of venting air bubbles which can become entrapped with the outflow of liquid 68.

The present invention has been described in an illustrative manner. It should be understood that modifications may be made to the specific embodiments shown herein without departing the spirit and scope of the present invention. Such modifications are considered to be within the scope of the present invention.

What is claimed is:

1. A closure for a container for a liquid, comprising:

a base collar engagable with the container and having an outlet aperture for dispensing the liquid and spaced therefrom at least one vent aperture of a small size and located by an offset distance which is within a predetermined range away from the outlet aperture with the offset distance being selected to seal the vent aperture by surface tension while the cap remains open so that the surface tension of the liquid can block the vent aperture, a primary liquid passageway extending through the base collar to the outlet aperture for dispensing liquid through the outlet aperture, and a secondary liquid passageway at least partly separate from the primary liquid passageway and extending through the base collar to the vent aperture for conveying the liquid from the container directly into contact with the vent aperture, a cap movable on the base collar between at least open and closed positions, a stop surface associated with one of the base collar and the cap and relatively movable to open and obstruct at least the primary liquid passageway as the cap is moved respectively between the open and closed positions, whereby the secondary liquid passageway permits air to enter the base collar to vent the closure for dispensing the liquid when the cap is in the open position and also seals the vent aperture by the surface tension of the liquid when dispensing of the liquid is to cease.

2. The closure of claim 1 wherein the predetermined range is from about 0.4 to 0.9 inches.

3. The closure of claim 2 wherein each vent aperture located within the predetermined range has a cross sectional area equivalent to a diameter of less than 0.10 inches.

4. The closure of claim 1 wherein each vent aperature located within the predetermined range has a cross sectional area equivalent to a diameter from about 0.09 inches to 0.03 inches.

5. The closure of claim 1 wherein the base collar includes a divider extending into a hollow interior region of the collar to at least partially separate the primary liquid passageway from the secondary liquid passageway.

6. The closure of claim 5 wherein the divider comprises a baffle which partially surrounds the secondary liquid passageway and has a longitudinal opening extending opposite from the primary liquid passageway.

7. The closure of claim 1 wherein the base collar extends from a bottom region having threads for attachment to the container to a top region containing the outlet aperture, and the at least one vent aperture is located in an intermediate region between the outlet aperture and the bottom region.

8. The closure of claim 7, wherein the base collar includes a divider extending from the intermediate region to the bottom region to separate the primary liquid passageway from the secondary liquid passageway.

9. The closure of claim 1 wherein the base collar includes a pair of extending pivot pins, and the cap includes legs rotatably mounted to the pivot pins and rotatable between the open and closed positions to form a flip top closure.

10. The closure of claim 9 wherein the cap further includes a resilient insert for closing the primary liquid passageway of the base collar when said cap is in the closed position.

11. The closure of claim 9 wherein the base collar has a top surface containing the outlet aperture and which has a shape of rotation about a pivot axis for the pair of extending pivot pins, and the cap includes a lower surface which has a shape of rotation about the pivot axis.

12. The closure of claim 9 wherein the base collar has a top collar surface which is angled, and the cap has an interior stop surface which is angled similarly to the top collar surface and obstructs the primary liquid passageway when the cap is in the closed position.

13. A closure for a container for a liquid, comprising:

a base collar engagable with the container and having an outlet aperture for dispensing the liquid and spaced therefrom at least one vent aperture, a dispensing passageway extending through the base collar to the outlet aperture for dispensing the liquid through the outlet aperture, a vent passageway extending through the base collar to the vent aperture to permit air to enter the base collar, a cap movable on the base collar between at least closed and open positions and having a skirt which extends over the base collar and overlaps the vent aperture as the cap is moved between the closed and open positions, an air passageway located between the skirt and the base collar and open at one portion to air and having another portion in direct contact with the vent aperture at least when the cap is in the open position, whereby the skirt of the cap overlaps and shields the vent aperture on the base collar.

14. The closure of claim 13 wherein the base collar includes a divider extending into a hollow interior region of the collar with one side of the divider forming the dispensing passageway and an opposite side of the divider forming a secondary liquid passageway extending into direct contact with the vent aperture for conveying a liquid from the container directly into contact with the vent aperture.

15. The closure of claim 14 wherein the at least one vent aperture is of a size and location on the base collar so that surface tension of the liquid will block the vent aperture when the cap is in the open position until a pressure difference causes dispensing of the liquid through the primary liquid passageway and venting air to enter the secondary liquid passageway.

16. The closure of claim 13 wherein the base collar includes at least one annular ring having a side wall extending generally longitudinally with respect to a primary liquid passageway extending through a hollow interior to the outlet aperture, and the skirt of the cap being slidably movable along the side wall of the annular ring to form a pull to open and push to close closure.

17. The closure of claim 13 wherein the base collar includes a pair of extending pivot pins, and the skirt of the cap is rotatably mounted to the pivot pins and is rotatable between the open and closed positions to form a flip top closure.

18. The closure of claim 13 wherein the skirt of the cap includes recessed portions under the skirt and forming an air passageway contiguous with the at least one vent aperture when the cap is in the open position.

* * * * *